US005313884A

United States Patent [19]

Lerner et al.

[11] Patent Number: 5,313,884

[45] Date of Patent: May 24, 1994

[54] REVERSE ROLLER COATING APPARATUS

[75] Inventors: Stanley Lerner, Glencoe; Steven B. Winter, Highland Park, both of Ill.

[73] Assignee: Color Communications, Inc., Chicago, Ill.

[21] Appl. No.: 862,406

[22] Filed: Apr. 2, 1992

[51] Int. Cl.[5] ..... B41F 1/46; B41F 31/14

[52] U.S. Cl. ..... 101/348; 118/261

[58] Field of Search ..... 101/348; 118/230, 244, 118/245, 246, 261

[56] References Cited

U.S. PATENT DOCUMENTS

| | | | |
|---|---|---|---|
| 917,857 | 4/1909 | Faifer | 118/245 |
| 1,663,232 | 3/1928 | Ambler | 118/247 |
| 3,511,696 | 6/1967 | Murray | 118/244 |
| 4,485,132 | 11/1984 | Furuzono et al. | 118/261 |
| 4,587,929 | 5/1986 | Connolly et al. | 118/261 |
| 4,743,330 | 5/1988 | Tillotson | 118/245 |
| 4,852,515 | 8/1989 | Terasaka et al. | 101/351 |

FOREIGN PATENT DOCUMENTS

| | | | |
|---|---|---|---|
| 0155808 | 1/1952 | Australia | 101/348 |
| 4599 | 11/1955 | Fed. Rep. of Germany | 101/348 |

*Primary Examiner*—Edgar S. Burr
*Assistant Examiner*—Anthony H. Nguyen
*Attorney, Agent, or Firm*—Fitch, Even, Tabin & Flannery

[57] ABSTRACT

Apparatus for coating a webbing uses rollers in contact with each other. The coating is applied to a first roller and coating thickness is limited by a knife blade. The coating travels to a point of contact with the second roller about which the webbing is wound, and the coating is thereby transferred to the webbing. By controlling the relative speed between the two rollers, the knife blade can be raised or lowered with respect to the first roller to attain greater control over the coating operation.

10 Claims, 5 Drawing Sheets 10
12
14
16
20
22
24
30
32
36
38
40
42
46
48
50
56
60
62
66
70
72
75
84
86
88
90
92
96
104
134
138
142
144

6
6

REVERSE ROLLER COATING APPARATUS

BACKGROUND OF THE INVENTION

1. Field of the Invention

The present invention pertains to apparatus for coating a substrate such a paper or plastic webbing.

2. Description of the Related Art

Two important techniques are used today in the art to apply a coating to a substrate. Each, however, has its own drawbacks. In one coating technique, a substrate is passed underneath a knife blade Positioned generally perpendicular to the path of travel of the substrate. A coating is applied with a greater thickness to the substrate, upstream of the knife blade. The material is typically much thicker than the desired final coating. The bottom, working edge of the knife blade is spaced a precise distance above the surface of the webbing to be coated, to meter the coating while setting a maximum thickness limit for the coating downstream of the knife blade. Also, the coating is spread onto the substrate surface by the knife blade, a feature which is sometimes relied upon to impart a desired finish to the coating. It is generally preferred that the coatings applied in this Manner are continuous and unchanging throughout the length of a production run, that is, from one section of substrate to another.

As those familiar with the art are aware, the knife blade application process offers significant advantages such as applying multiple coatings to a single substrate, but is subject to streaking which must be carefully monitored during a production run. The problems considered here are associated with small particles present in the coating material, which are of a size approaching the gap between the knife blade and the webbing surface. The knife gap in commercial applications is typically very small, of the order of 1 to 2 mils. The particles may comprise airborne contaminants, or perhaps paper fibers which are present in the environment. The particles may also comprise constituents of the coatings. Paint formulations typically include a liquid vehicle to which one or more colorants are added. These colorants often take the form of solid particles which are finely ground and dispersed throughout the paint base. Different colors and types of coatings have different coloring agents exhibiting a fairly wide variety of particulate sizes and characteristics. Some colors and coating types are especially prone to having larger size particles in the liquid suspension. Coatings containing these particles are applied to the substrate immediately upstream of the knife blade and are made to pass underneath the knife blade due to the momentum of the substrate. If the particles are of a size on the order of the gap between the knife blade and the substrate, an imperfection in the coating, which frequently is visible to the unaided eye as a streak, will result. In some applications, it is important that the coating be uniform throughout a relatively long production run. For example, in the manufacture of color samples, a substrate many feet in length will be coated with one or more stripes of different coating materials, and later divided into swatches or "chips" on the order of a inch square in size. Very often, a coating imperfection due to an overly large particle passing underneath a knife roller will be of a size sufficient to spoil several chips. While the coatings can be subjected to unusual preprocessing steps such as filtration or ultra-filtration techniques, these steps are of themselves costly to operation and may prove commercially impractical for some jobs.

In another popular technique used today, a series of rollers apply coating to a substrate. A primary roller is partly immersed in a coating material and transfers the material to a series of downstream rollers, which in turn, convey the material to a substrate. Roller coating devices can deliver a good quality coating across the width of a web, but cannot simultaneously apply multiple coatings to the same substrate, as can be done with the knife coating process.

SUMMARY OF THE INVENTION

It is an object according to the present invention to provide a simplified apparatus which overcomes the above-stated deficiencies while combining the advantages of knife coating and roller coating techniques.

A further object according to the present invention is to use knife coating techniques to simplify multicolor coating of a substrate while eliminating streaking in the finished product.

Yet another object according to the present invention is to reduce or eliminate static charges in the coating process.

These and other objects which will become apparent from studying the appended description, taken in conjunction with the drawings, is provided in an apparatus for coating a webbing, comprising:

a feed roller about which a webbing is at least partially wound;

means for rotating the feed roller;

a transfer drum adjacent the feed roller, having an outside surface;

means for rotating the transfer drum;

supply means for supplying a coating material to the outside surface of said transfer drum;

a doctor blade adjacent the transfer drum surface, downstream of said supply means for limiting the thickness of the coating material passing in a downstream direction underneath the doctor blade; and locating means for locating said feed roller adjacent the outside surface of said transfer drum so as to bring webbing wound about said feed roller into contact with the coating material carried on the transfer drum to thereby transfer the coating to the webbing.

DETAILED DESCRIPTION OF THE PREFERRED EMBODIMENT

Figure 1:
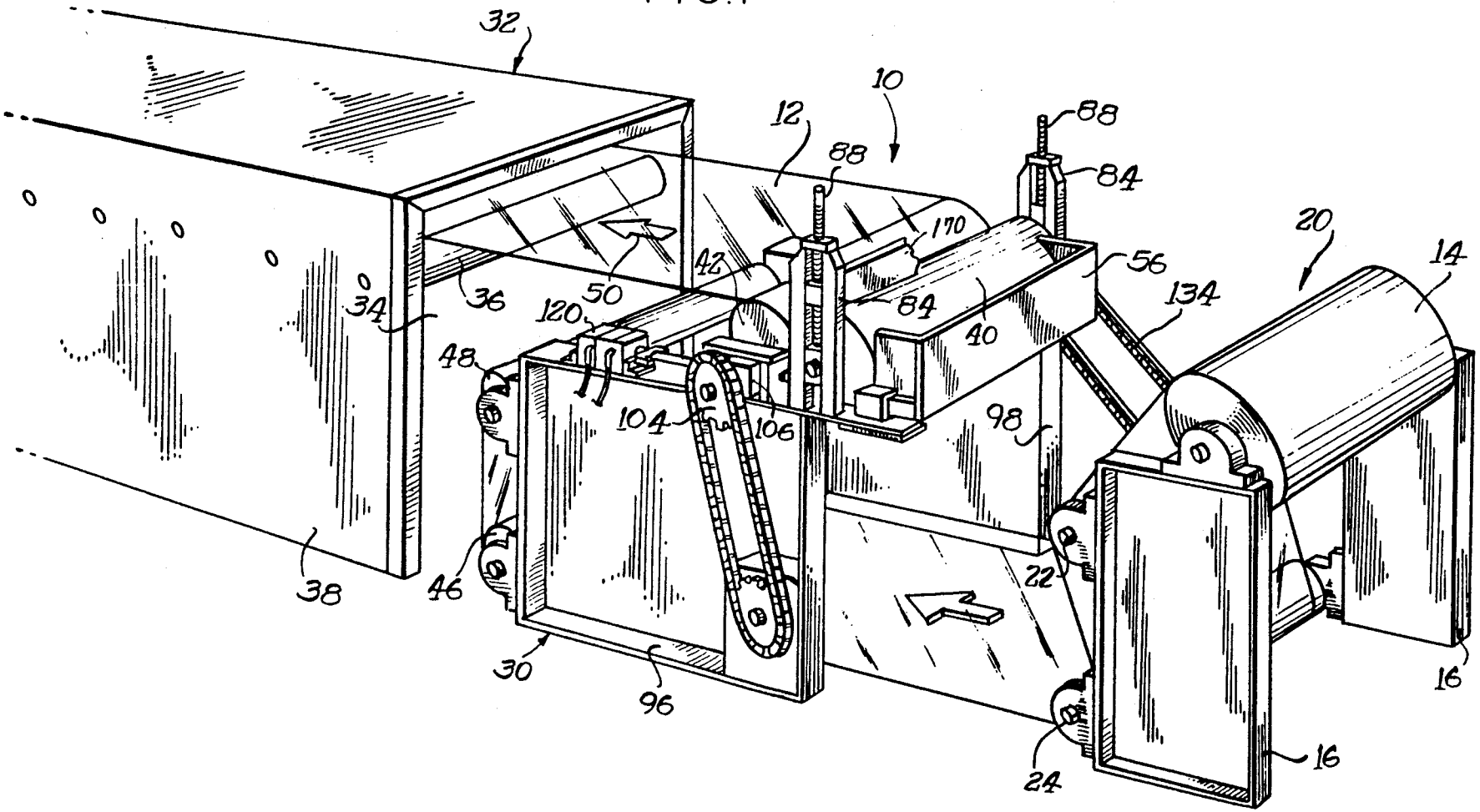
FIG. 1 is a perspective view of coating apparatus according to principles of the present invention.
Figure 2:
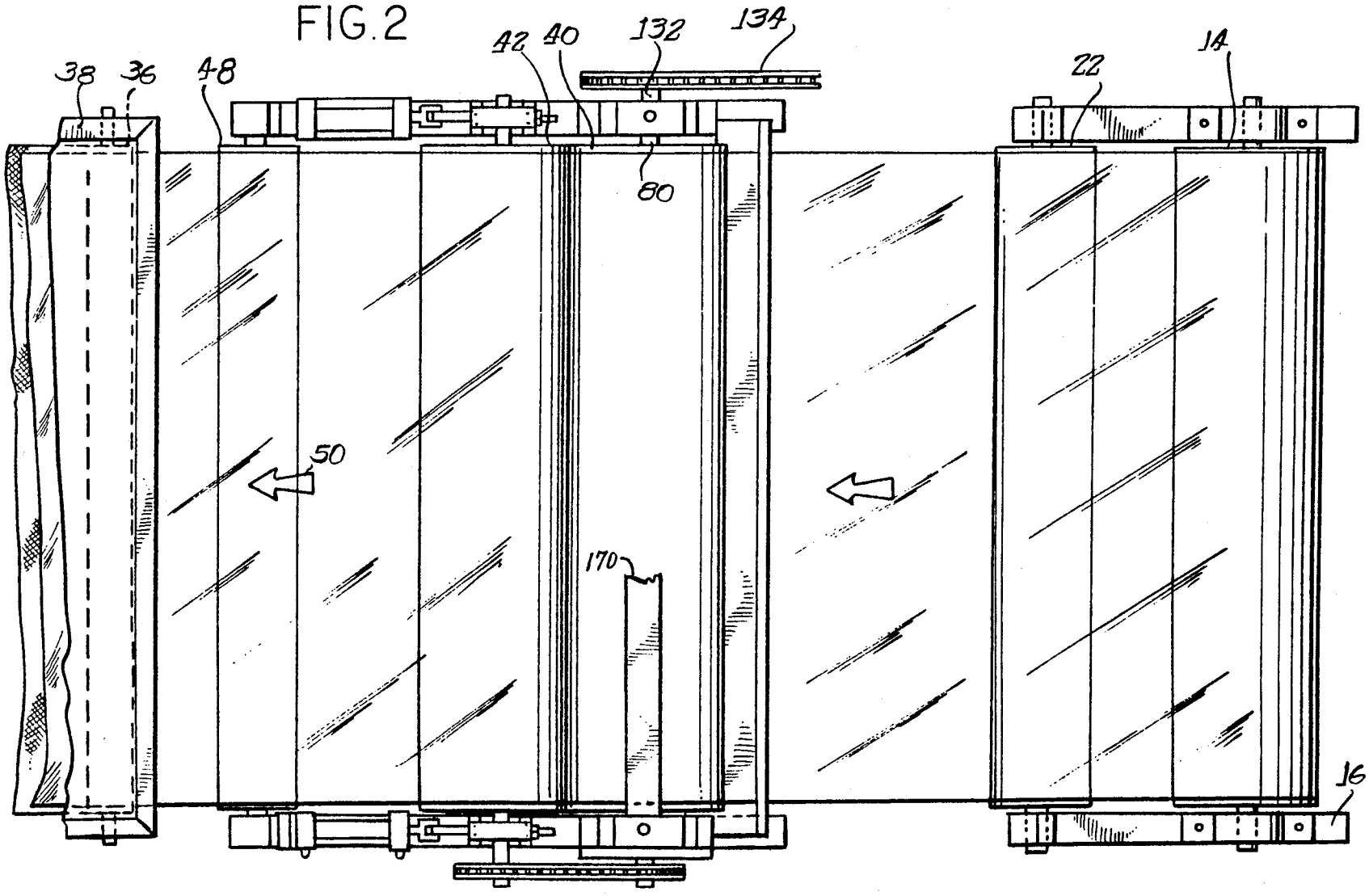
FIG. 2 is a plan view thereof.

Referring now to the drawings, and initially to FIGS. 1–4, coating apparatus according to principles of the present invention is generally indicated at 10. The coating is applied to a webbing substrate 12. A roll 14 of the webbing is mounted on frames 16 at the upstream end of the apparatus. The webbing roll 14 and supports 16 are located at a webbing supply workstation, generally indicated at 20, which is located at the upstream end of apparatus 10. Rollers 22, 24 guide and tension the webbing which is fed to a coating workstation generally indicated at 30.

As will be seen herein, the coating is applied to webbing 12 at workstation 30 and is then fed to a drying workstation generally indicated at 32 which has an open, upstream entrance end 34. The webbing is supported by a series of rollers 36 as it passes through an enclosure 38. Suitable drying means may be located within housing 38, and preferably both a heat source and forced air means are used to accelerate the drying time of the coating such that the coated webbing may be continuously wound about a storage roll (not shown).

Coating station 30 comprises a pair of rollers including an upstream, transfer drum or roller 40 and a downstream feed or backup roller 42. The webbing 12 is passed over a series of tensioning rollers including rollers 46, 48 shown in FIG. 1, so that the webbing enters the nip between rollers 40, 42 from below, passing above roller 42 toward the drying workstation 32, as indicated by arrow 50.

Figures 3, 7:
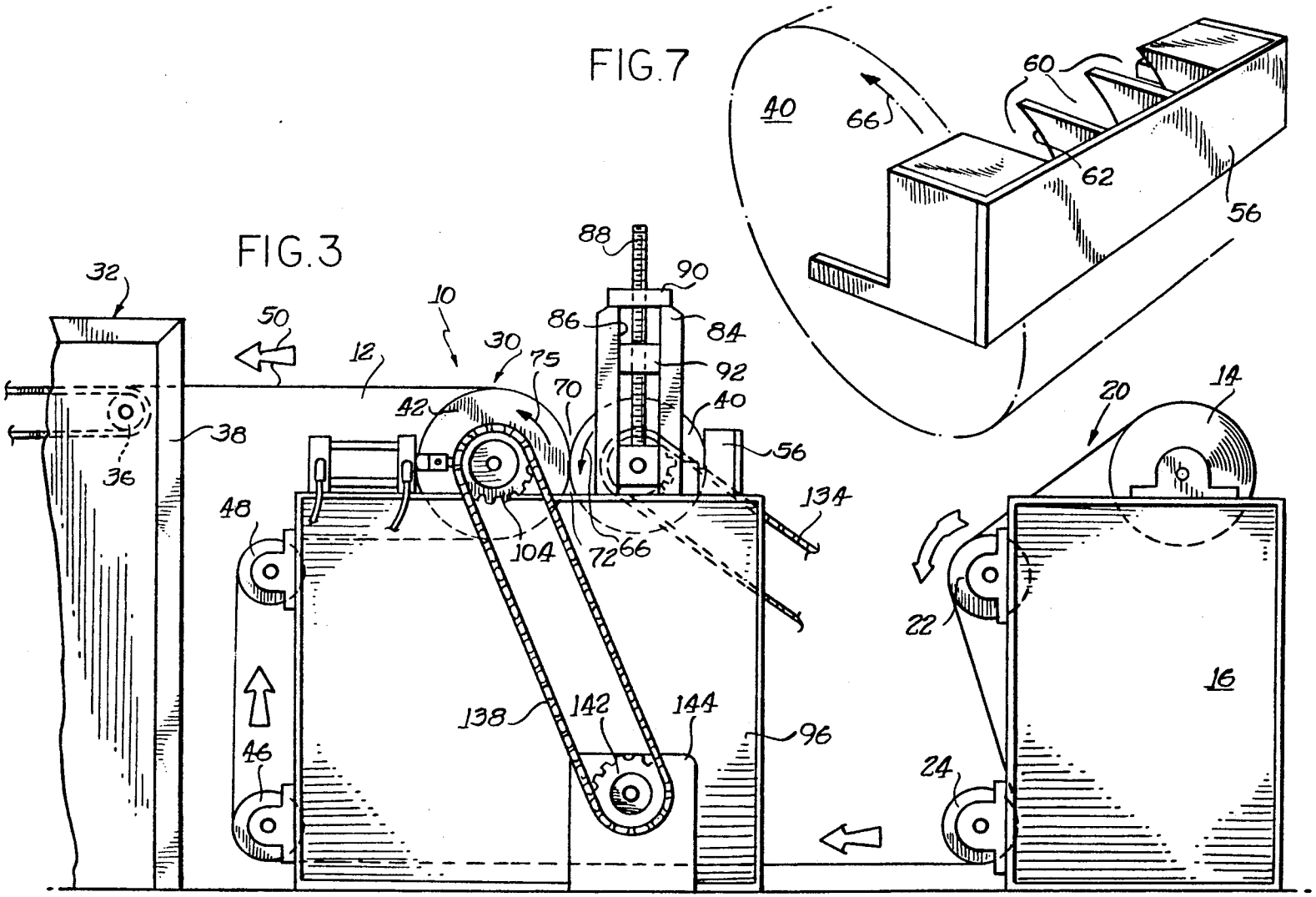
FIG. 3 is a fragmentary side elevational view thereof.
FIG. 7 is a fragmentary perspective view of a coating application station.
Figures 4, 5, 6:
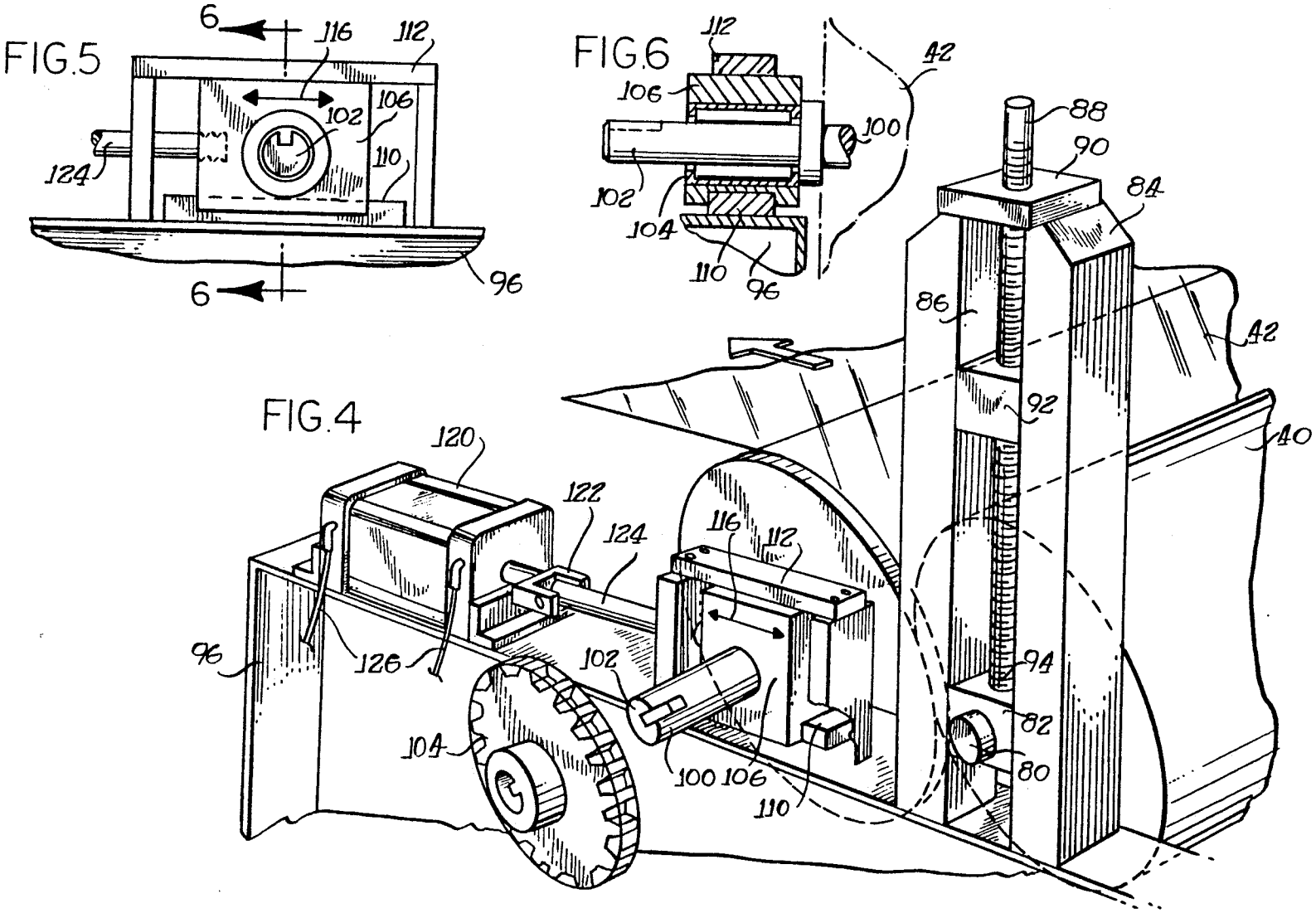
FIG. 4 is a fragmentary perspective view thereof.
FIG. 5 is a fragmentary elevational view showing the roller adjustment of FIG. 4.
FIG. 6 is a fragmentary cross-sectional view taken along the line 6—6 of FIG. 5.

Preferably, the rollers 40, 42 are aligned with their central axes generally perpendicular to the direction of travel of webbing 12. The rollers 40, 42 are preferably of similar length and are aligned parallel to one another and spaced so that their outer surfaces are either very close to one another or engage one another with a preselected pressure, as indicated in FIG. 3, for example. In the preferred embodiment, the transfer roller 40 is preferably made of steel or other incompressible hard material while backup roller 42 has a steel core covered with an outer compressible, preferably rubber covering.

A segmented tray 56 is located next to transfer roller 40, on a remote side of transfer roller 40, such that the transfer roller 40 is interposed between tray 56 and backup roller 42. As can be seen in FIG. 7, tray 56 may be divided into a number of different compartments 60, each for carrying a different coating, for example paint coatings of different colors. Tray 56 has an edge surface 62 conforming to the outer surface of transfer roller 40, and is pressed thereagainst to provide a fluid-tight seal.

Roller 40 is driven in the direction of arrow 66 so that coating applied to the roller by tray 56 is carried to the upper nip 70 between rollers 40, 42. As mentioned, webbing 12 enters between rollers 40, 42 from below, passing through the lower nip 72 between the rollers. Roller 42 is driven in the same rotational sense as roller 40, as indicated by arrow 75 in FIG. 3.

Figure 8:
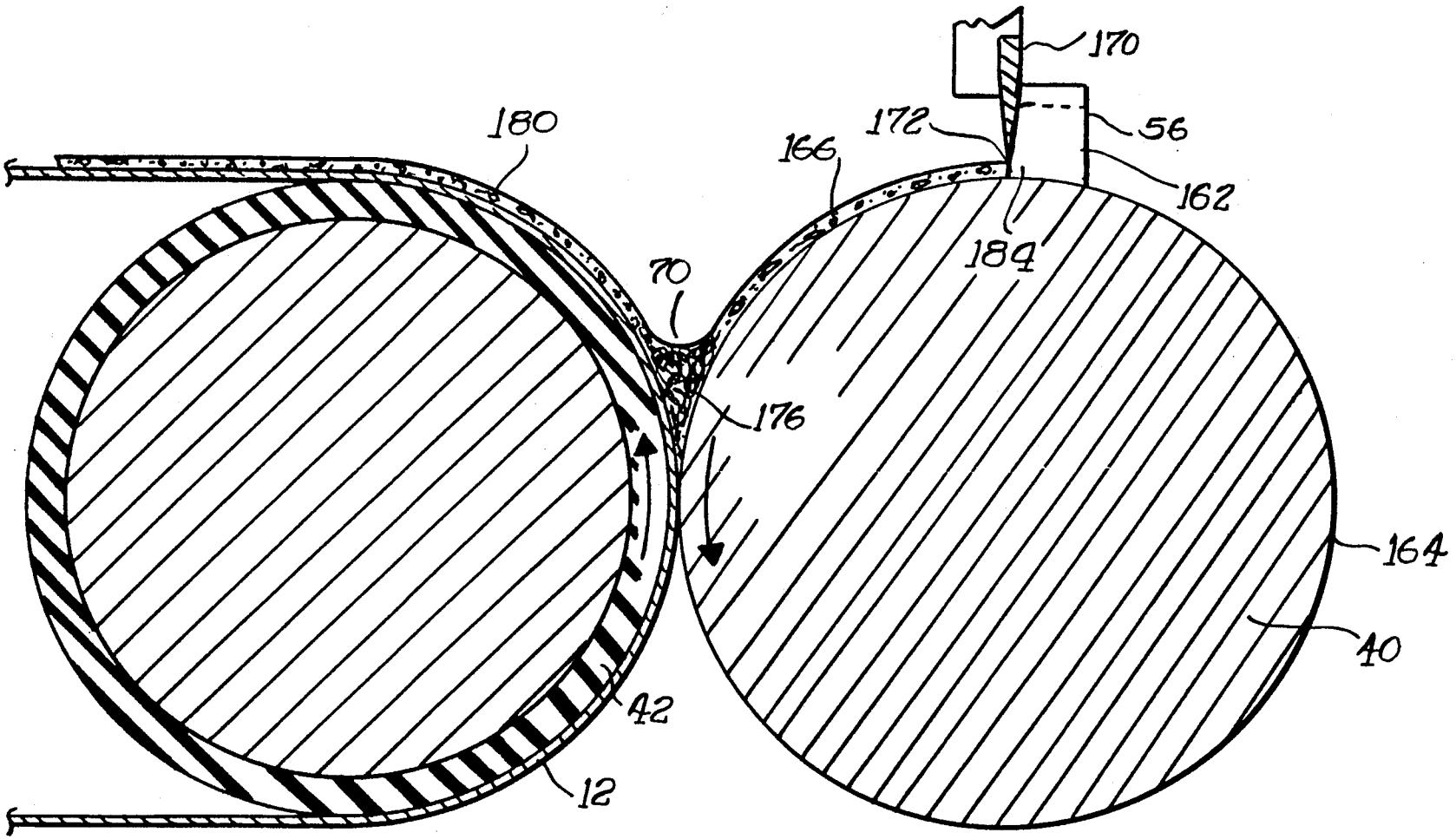
FIG. 8 is a fragmentary schematic view, taken on an enlarged scale, showing the printing rollers in greater detail.

As can be seen in FIG. 3, for example, webbing 12 is wrapped about a reverse or backup roller 42 and is in frictional contact therewith so as to be driven in the downstream direction of arrow 50. As can be seen in FIG. 3, at the point of contact between rollers 40, 42, the outer surfaces of the rollers are travelling in opposing directions and accordingly, a sufficient amount of rotational driving force must be applied to webbing 12 to insure a desired, steady downstream travel of the webbing. For the arrangement of the preferred embodiment, where roller 42 provides driving force for propelling webbing 12, it is desired that the webbing overlie a substantial portion of the outer surface of roller 42. As can be seen in FIG. 3, it is preferred that webbing 12 be wound about half the surface of roller 42 in order to insure an adequate frictional engagement and rotational drive of the webbing, despite the opposing force of roller 40. The present invention also contemplates driving the rollers 40, 42 in opposite rotational directions so that the tangential velocities of the rollers at the point of contact (that is, at the nip between the two) is in the same direction. Such an arrangement might be provided, for example, where a larger range of knife gap openings is not required. As will be seen herein, the unidirectional rotation of both rollers 40, 42 provides a wide range of control of final coating thicknesses on webbing 12, so as to allow a wide range of coating thicknesses and transfer rates. For example, the knife blade gap which sets the coating thickness on transfer roller 40 can be opened up or increased, with the coating applied to webbing 12 being reduced by increasing the rotational speed or diameter of the backup roller 42. The knife blade has not been shown in FIGS. 1–6, for purposes of clarity. Referring to FIG. 8, a doctor blade or knife blade 170 is located above the center line of transfer roller 40 and has a lower knife edge 172 spanning the length of roller 40, and spaced slightly thereabove with a gap dimension ranging between a fraction of 1 mil to 10 mils.

As can now be seen, it is important that movable support or adjustment be provided for each roller 40, 42, independently of one another so as to bring the rollers into alignment with webbing 12 and to provide the desired spacing and orientation of the rollers for an operation. With reference to FIGS. 1–4, and especially to the enlarged view of FIG. 41 transfer roller 40 includes a mounting shaft 80 mounted in a travelling or carriage block 82. A relatively massive frame 84 defines a hollow housing with a channel 86 within which carriage block 82 is free to reciprocate. As can be seen in FIGS. 1 and 3, for example, the frame 84 is supported by sidewall members 96, 98. A lead screw 88, threadingly engaged with members 90, 92 has a lower end 94 rotatably coupled to carriage block 82, so as to provide a vertical adjustment for the mounting shaft 80 of roller 40. Thus, the generally horizontally extending shaft 80 can be brought into desired alignment with roller 42, so as to move the nip between rollers 40, 42 to a desired angular position with respect to the center line of roller 42.

Turning again to FIGS. 1–4, and especially to FIG. 4, backup roller 42 has a central mounting shaft 100 with a keyed end 102 for mating with a gear 104. The shaft 100 is mounted in a slide or carriage block 106 (see FIG. 6). Carriage block 106 has a channel recess at its bottom portion for receiving a rail or guide block 110 which extends in the direction of webbing travel. An outer hollow frame 112 confines the guide block for moving back and forth in a generally horizontal direction, the direction of webbing travel, as indicated by double-headed arrow 116 of FIG. 4. The carriage block 106, slide block 110 and outer frame 112 comprises part of a locating means with movable support for altering the gap and/or pressure between rollers 40, 42. The locating means further includes an electromagnetic operator or solenoid 120 having a yolk shaft 122 coupled to a link rod 124. The forward, free end of link rod 124 is coupled to carriage block 106 and, as solenoid 120 is energized by electrical leads 126, the guide block 106 and shaft 100 are reciprocated, being moved toward and away from transfer roller 40.

According to one aspect of the present invention, the shafts 40, 42 each have their own independent drive systems. For example, a gear 130 is connected to a free end 132 of shaft 80 (see FIG. 2). A drive chain 134 engages gear 130 to drive roller 40 in the desired direction, at a preselected speed determined by the gear ratios. Drive chain 134 is connected to a motor-driven sprocket (not shown), but which is similar to the gear sprocket 142 (see FIG. 3). A drive chain 138 engages gear 104 to drive roller 42 with a desired direction and rotational speed. Chain 138 is coupled to a gear sprocket 142 which is driven by a motor 144. By adjusting the motor speeds and gear ratios for the drive assemblies associated with rollers 40, 42, the rollers can be operated at virtually any desired direction and rotational speed. According to one aspect of the present invention, it is preferred that motor 144 and gears 104, 142 be chosen such that roller 42 rotates at a speed which results in reducing the thickness of the coating applied to webbing 12, as compared to the thickness of the coating applied to transfer roller 40.

Referring to the schematic view of FIG. 8, a liquid coating 162 in tray 56 is picked up by roller 40 as the roller passes the tray, forming a layer 166 of coating material on the outer surface 164 of roller 40. Preferably, the rotational speed and outer surface 164 of roller 40 is chosen so that layer 166 is somewhat thicker than the desired transfer roller coating 166, located downstream of knife blade 170. The lower sharpened tip 172 of knife blade 170 limits the thickness of coating on roller 40, and insures that the coating 166 is of a desired preselected thickness. The coating 166 follows roller 40 until contact is made with roller 42, with the coating thereby being located at the upper nip 70 between the rollers. Preferably, webbing 12 carried by backup roller 42 is pressed against roller 40 so as to form a fluid-tight barrier which preserves a desired level of coating material in the area indicated by numeral 176 in FIG. 8, located at upper nip 70.

Webbing material passing through area 176 picks up coating material, thereby forming the final coating 180 on portions of webbing 12 passing downstream of the roller nip. As mentioned, rollers 40, 42 preferably rotate in the same direction so as to have tangential velocities which are oppositely directed at the point of contact between the two rollers. According to one aspect of the present invention, the relative speed between rollers 40, 42 is determined beforehand so as to achieve a final coating thickness 180 of a desired magnitude. One advantage of the present invention is that the final coating 180 can be made substantially thinner than the coating 166 on transfer roller 40. Accordingly, to achieve the same final coating thickness on webbing 12, the backup roller 42 can be operated at a relatively slower speed for a given gap 184 between the knife blade and outer surface 164 of roller 40. Alternatively, for the same thickness of final coating 180, both the gap 184 and relative speed of roller 42 can be increased.

Those skilled in the art will now appreciate an important advantage of the present invention. At times, particulate substances are found in the coating material and, when these particles or masses of particles approach the size of the knife blade gap 184 or have a size representing a substantial proportion of the gap size, defects in the final coating result, which can visibly mar the appearance of the final coating. This has been one recognized problem in conventional knife blade coating applications where the substrate to be coated passes under the knife blade, that is, where a single application roller is used.

In the present invention, particles passing under the knife blade do not directly adhere to the substrate, but rather enter the area 176 at the upper nip between the rollers 40, 42. Very substantial shear forces are present in area 176 created by the oppositely directed surface velocities of the rollers. It has been found that there is a substantial churning action in the area 176 which, for commercially practical coatings, surprisingly eliminates or greatly reduces the number of visible defects in the final coating 180. It is believed that the shear forces, churning action and turbulence in the area 176, either alone or in combination, are sufficient to break down the particle size of particles passing underneath knife blade 170.

Defects caused by particle groups, or agglomerations of colorant particles which occasionally pass under knife blade 170 have been significantly reduced. As those skilled in the art are aware, paint coatings typically include one or more colorants which frequently have a particulate component. These particulate components are very finely divided, but tend to agglomerate with the passage of time, and will be present in the coating material. With the present invention, these particulate agglomerations have been found to break up, that is, to reduce in size and number with residence in area 176 for time durations typically encountered in commercial coating operations.

The present invention provides further advantages in that the knife blade gap 184 can be increased, even while controlling the coating process so as to attain a final coating thickness substantially less than the knife gap width. For example, if the relative speed of back up roller 42 is increased, other factors being equal, the thickness of final coating 180 will decrease in relation to the speed increase. It has been found, for some types of coatings, that larger size particulate agglomerations and particles are not visually objectionable as long as they are not made to undergo substantial contact with knife blade 170, but rather, pass underneath the knife blade substantially unchanged. With the present invention, the knife blade gap can be increased so as to reduce or eliminate particle extrusion or other deformation underneath knife blade 170. As mentioned, these larger size particles may, for some coatings, tend to be reduced in size in area 176. However, for other types of coatings, particle size reduction may not be important if transfer of the final coating portion 180 can be tolerated. Such tolerance of the particles is increased for particles which have not been damaged by knife blade 170.

As can now be seen, the present invention allows the coating of special effects heretofore achieved using knife-over-roll coating methods, using superior reverse roller coating techniques so as to provide greater control over the coating process. In addition, the present invention minimizes the streaking and similar coating defects usually associated with contaminants in the coating material, which when moved into contact with the knife, visibly mar the finished coating. At times, the contaminants block the flow of coating material underneath the knife, when the contaminants are too large to pass through the gap between the knife and the roller. The contaminants need not necessarily be physically larger than the gap, but need only approach the gap dimension in order to visibly mar the finished coating. With the present invention, the gap between the knife and roller can be increased, thereby reducing these harmful effects. In addition, an agitation zone between the rollers 40, 42, has been observed to minimize visible marring of the finished coating, believed to result from the churning motion of the coating material in the agitation zone.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for coating a webbing with a liquid coating material, the apparatus comprising:

a feed roller with an outer surface about which a webbing is adapted to be at least partially wound;

means for rotating the feed roller;

a transfer roller adjacent the feed roller, the transfer roller having an outside surface from which the liquid coating material is transferred to a reservoir formed between the fed roller and the transfer roller;

means for rotating the transfer roller in the same direction as the rotation of the feed roller;

supply means for supplying the liquid coating material to the outside surface of said transfer roller;

a doctor blade adjacent the transfer roller surface, downstream of said supply means and spaced upstream from the reservoir for limiting the thickness of the liquid coating material passing in a downstream direction underneath the doctor blade; and locating means for locating said feed roller adjacent the outside surface of said transfer roller so as to bring webbing wound about said outer surface of said feed roller into contact with the liquid coating material in the reservoir; the surface speed of the transfer roller relative to the surface speed of the feed roller being such that the liquid coating material being carried to the reservoir by the transfer roller is sufficient to deposit on the webbing a coating of preselected thickness.

2. The apparatus of claim 1 wherein said feed roller and said transfer roller are generally parallel to one another and have generally the same length.

3. The apparatus of claim 1 wherein said locating means includes movable support means for movably supporting at least one of said transfer roller and said feed roller to adjust the relative position of one with respect to the other.

4. The apparatus of claim 3 wherein said movable support means comprises reciprocating means for reciprocating said feed roller back and forth, in a generally horizontal direction.

5. The apparatus of claim 4 wherein said reciprocating means comprises an electromagnetic solenoid coupled to said feed roller with coupling means.

6. The apparatus of claim 5 wherein said coupling means comprises a slide block supporting one end of said feed roller disposed within a hollow frame and coupled to said solenoid with linkage means.

7. The apparatus of claim 6 wherein said slide block defines a channel and said hollow frame includes a rail means at least partly receivable within said channel to guide said slide block.

8. The apparatus of claim 3 wherein said movable support means comprises a travelling block supporting one end of said transfer roller disposed within a hollow housing which guides said travelling block for movement in a direction angled away from the horizontal.

9. The apparatus of claim 8 wherein said movable support means further comprises adjusting screw means supported by said housing and engaged with said travelling block so as to translate said travelling block back and forth within said hollow housing.

10. The apparatus of claim 1 wherein the outer surface of the feed roller is resilient and the outside surface of the transfer roller is generally incompressible.

* * * * *